US006186464B1

(12) United States Patent
Whitman

(10) Patent No.: US 6,186,464 B1
(45) Date of Patent: Feb. 13, 2001

(54) BOOK HOLDER ADAPTER

(76) Inventor: Nicholas Lechmere Whitman, 40 Fleet St., Apt. #5, Boston, MA (US) 02109

( * ) Notice: Under 35 U.S.C. 154(b), the term of this patent shall be extended for 0 days.

(21) Appl. No.: 09/344,586

(22) Filed: Jun. 25, 1999

(51) Int. Cl.[7] ..... A47B 97/04; A47B 5/04
(52) U.S. Cl. ..... 248/444; 248/444.1
(58) Field of Search ..... 248/444, 444.1, 248/459, 442.2

(56) References Cited

U.S. PATENT DOCUMENTS 4,243,249 * 1/1981 Goss ..... 248/444
5,620,162 * 4/1997 Beckwith et al. ..... 248/442.2
5,697,594 * 12/1997 Adams et al. ..... 248/441.1
5,823,500 * 10/1998 La Coste ..... 248/444
5,829,787 * 11/1998 Newhouse, Jr. ..... 248/444.1
5,887,839 * 3/1999 Smith et al. ..... 248/444

* cited by examiner

*Primary Examiner*—Ramon O. Ramirez
*Assistant Examiner*—Jerome DeLuca
(74) *Attorney, Agent, or Firm*—Don Halgren

(57) ABSTRACT

The present invention is a book holding device for permitting the comfortable holding of a book by a single hand of a reader of said book. The holding device comprises a sheath arranged for receipt of a reader's finger. A frame assembly is attached to the sheath. The frame assembly is arranged to supportively receive at least one side of a book. The frame assembly is preferably movable with respect to the sheath. The frame assembly is preferably comprised of a plurality of articulable panels including a first panel attached to the sheath, and a second panel hingedly attached to the first panel. A third panel is preferably hingedly attached to the second panel by a hinge arranged therebetween. One side of the book rests upon the second panel and is sandwiched between the first and third panels.

11 Claims, 3 Drawing Sheets

BOOK HOLDER ADAPTER

BACKGROUND OF THE INVENTION

1. Field of the Invention

This invention relates to devices for holding of books, and more particularly to a hand mounted apparatus to permit a book to be held by one hand of a user.

2. Prior Art

Our society has become one of readers. People read on trains, airplanes, automobiles, in their homes, in their offices, and in their schools. Making reading easier to accomplish is a worthwhile goal. Often, readers try to hold their book with one hand while writing, eating, or just sitting. It is always problematical however to easily hold a book open so that both pages facing the reader stay held in place and flat, while that book is being held in a comfortable manner without fatigue.

It is an object of the present invention, to provide a reader with a device to permit the reader to hold the book open comfortably, with just one hand.

It is yet a further object of the present invention, to provide a reader with a device that is small, portable, collapsible, easy to manufacture, and readily utilizable in the reading of relatively any size book that may be held in one hand.

It is still yet a further object of the present invention, to provide a book holding device that would readily fit on any readers hand, be that reader a child or an adult.

BRIEF SUMMARY OF THE INVENTION

The present invention relates to a book holding device, which is readily mountable on the users or readers hand. The book holding device comprises a frame assembly, which in one preferred embodiment, is of generally U-shaped configuration. The framed assembly of the first embodiment comprises a first panel having a flexible, generally tubular shaped sheath attached thereto. The tubular sheath maybe openable and sealable along its side portion, or adjustable by a Velcro™ means or the like. The tubular sheath attached to the first panel may have securement means arranged therebetween, such as rivets or the like to permit rotation of the sheath with respect to the panel. The first panel has a lowermost end, with a second panel thereattached. The second panel may be rigidly formed at the lowermost end of the first panel, or the second panel may be hingedly attached to the first panel which in its open configuration forms a generally L-shape. The second panel, in a preferred embodiment, may have a third panel there attached. The third panel may be attached to the distalmost end of the second panel by a hinge or the like. The third panel in a preferred embodiment, may be shorter in length than the length of the second panel, to permit rotation and articulation between the first, second, and third panels for storage purposes. The third panel, in its openmost configuration, is generally parallel to the plane of the first panel.

In its fully open configuration, a book may be inserted between the first panel and the third panel so as to hold the pages properly compressed. It is preferred, that at least the third panel is constructed from a clear plastic material so as to permit the user or the reader to see therethrough.

In operation of the first preferred embodiment, the fourth or third finger of either hand may be placed within the generally cylindrically shaped flexible sheath with the first panel being supported against the inwardly facing side of the hand. The second and the third panels are thus opened so as form a generally trough-like or U-shaped configuration for the receipt of the lower edge of a book therein. The thumb of that same hand may be utilized by the reader to hold the other half portion of the pages of the book open, as the reader wishes to hold and support that book with that "one" hand to which the book holding device is attached.

A further configuration of the first preferred embodiment of the present invention, involves the use of the book holding device with the generally cylinder shaped sheath rotated 90 degrees to the longitudinal axis of the first panel. This permits the second panel to be in engagement with the side edges of the book being held and not the lowermost edge of the book, when the user is supporting a book in one hand.

In yet a further preferred embodiment of the present invention, a generally cylinder shaped flexible sheath of about 2 centimeters in length, has a first panel fixedly attached thereto. The sheath and first panel have a first end to which a second panel is attached. The second panel may be attached by a hinge to the end of the first panel. The second panel is preferably transparent, inasmuch as it covers a portion of the page to be read by the reader holding the book. In a further embodiment of the present invention, the first and second panel may be a generally L-shaped extrusion, not being hingedly arranged with respect to one another.

In operation of the second preferred embodiment of the present invention, the generally cylinder shaped sheath is placed on one of the fingers of one hand, so that the second panel may be flipped up in an upright orientation nearest the distal tip of the finger and generally perpendicular to the longitudinal axis of the distal most end of the finger. A book may be placed between the second panel and the palm side surfaces of the remaining fingers of the users hand in which is holding the book. The second panel may be arranged so as to hold one side of the book against the reader's fingers, and the reader's thumb is holding the other side of the book thereagainst as well.

Thus what has been shown is a unique readily manufactureable device for permitting a user or reader to hold a book with only one hand. The device includes a flexible, size adjustable, finger encircling sheath onto which a panel is attached. The panel is supported by the sheath which is placed about the finger to permit a book to be held between the panel and the remaining fingers of a single hand. This arrangement permits a reader to comfortably and easily maintain a book in its open orientation between the device, the fingers, and the thumb of one hand while permitting the users other hand for writing, eating, or the like.

The invention thus comprises a book holding device for holding of a book by one hand of a reader of said book, including a sheath arranged for receipt of a reader's finger, a frame assembly attached to the sheath, the frame assembly being arranged to supportively receive at least one side of a book. The frame assembly may be movable with respect to said sheath. The frame assembly may be comprised of a plurality of articulable panels. A first panel is attached to the sheath, and a second panel is attached to the first panel. The second panel may be hingedly attached to the first panel by a hinge arranged therebetween. A third panel is attached to the second panel. The third panel may be hingedly attached to the second panel by a hinge arranged therebetween. The third panel is preferably fabricated by a transparent material to permit a book page to be read therethrough. The frame assembly may be rotatable with respect to the sheath. The frame assembly may be attached to the sheath by a rivet arrangement. The sheath is preferably fabricated from a flexible material. The sheath is preferably adjustable in size.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 1:
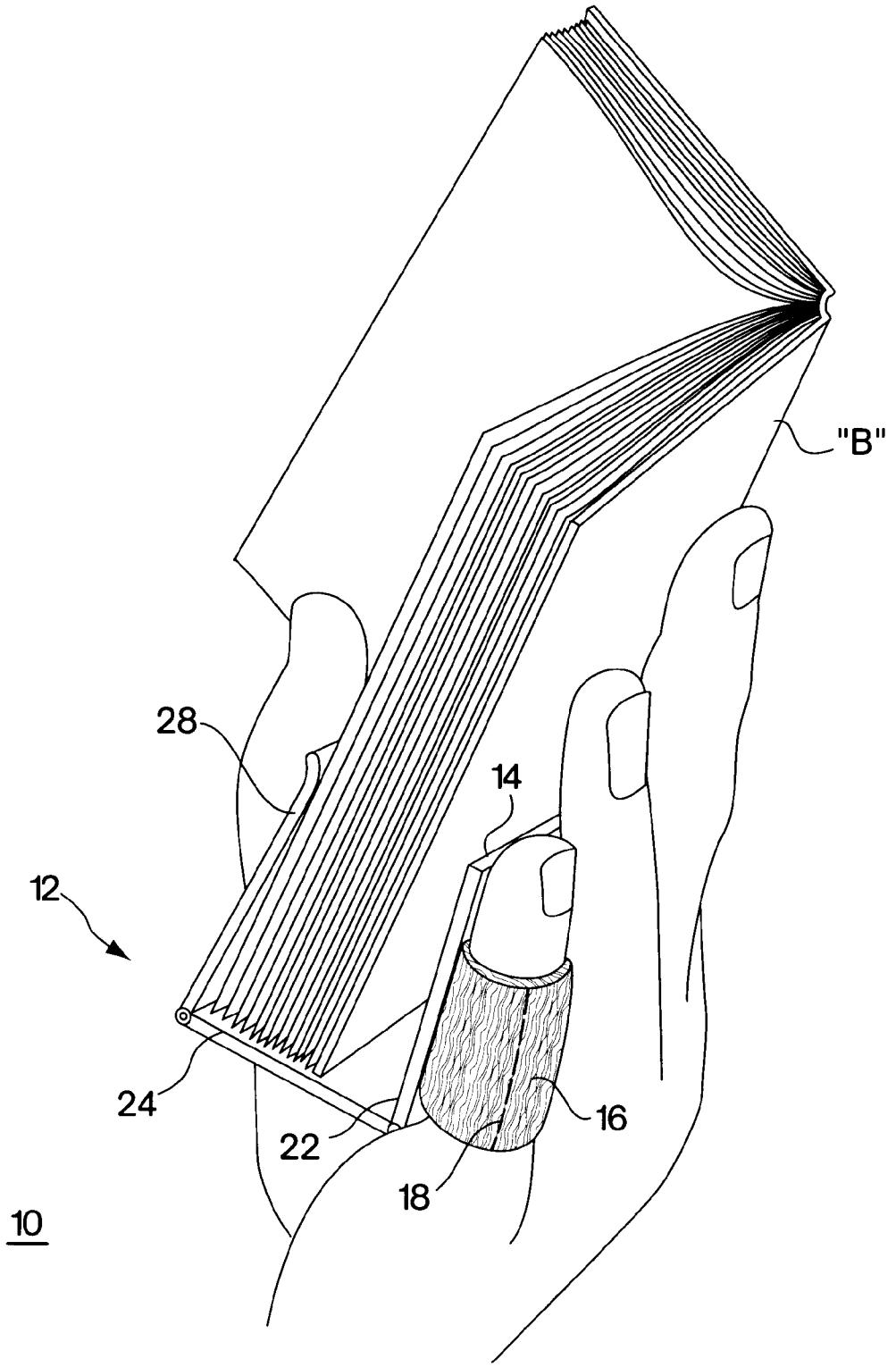
FIG. 1 is a perspective view of the present invention arranged on a hand of a user, showing a book supported thereby.
Figure 2:
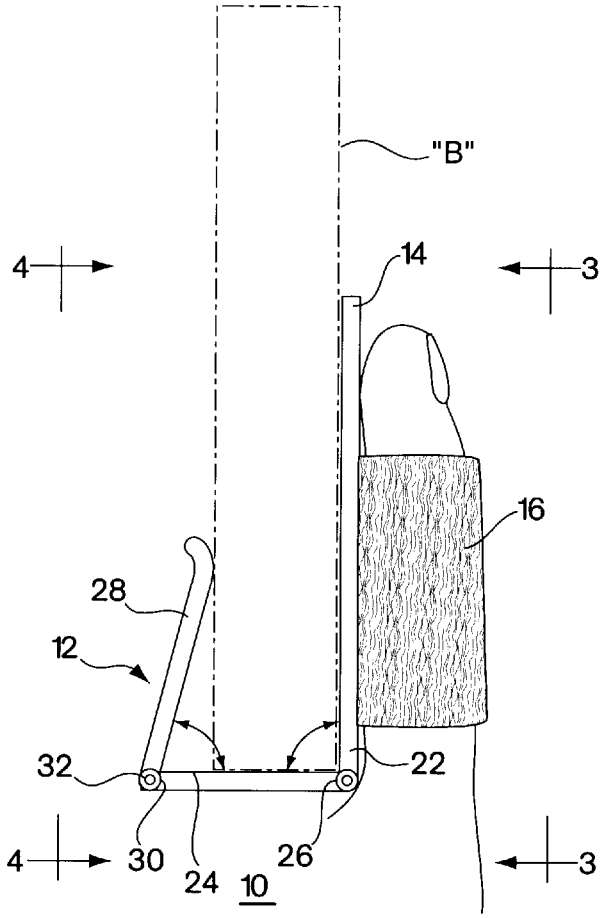
FIG. 2 is a side elevational view of the present invention.
Figure 3:
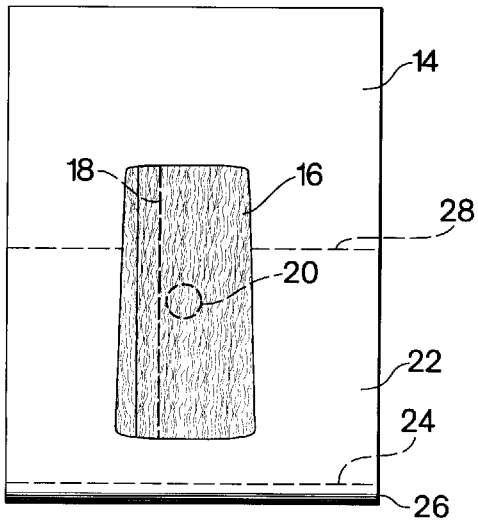
FIG. 3 is a view taken along the lines 3—3 of the FIG. 2.
Figure 4:
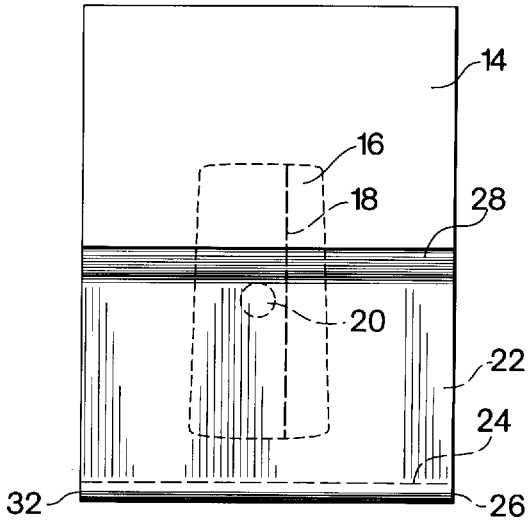
FIG. 4 is a view taken along the lines 4—4 of FIG. 2.
Figure 5:
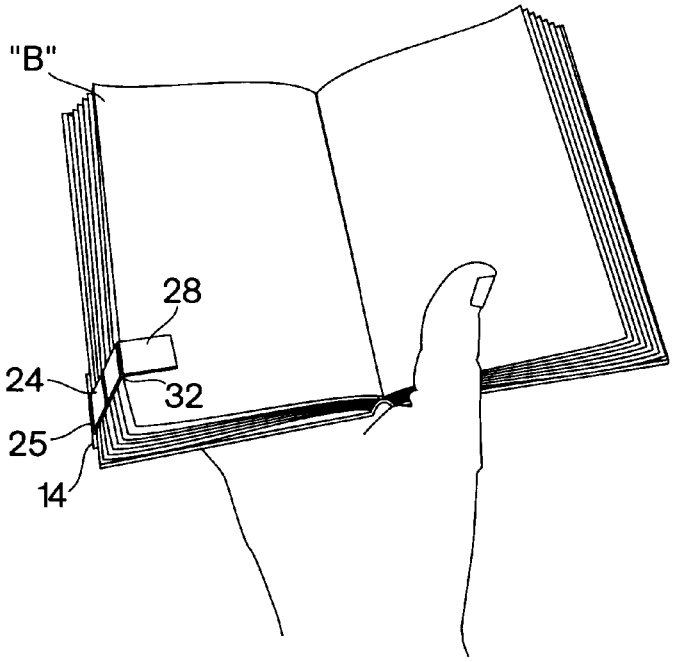
FIG. 5 is a perspective view of the present invention with a further embodiment thereof.

Referring now to the drawings in detail, and particularly to FIGS. 1 and 2, there is shown the present invention which comprises a book holding device 10, which device 10 is readily mountable on the user's or reader's hand. The book holding device 10 comprises a frame assembly 12, which in one preferred embodiment, is of generally U-shaped configuration. The frame assembly 12 of the first embodiment comprises a first panel 14 having a flexible, generally tubular shaped sheath 16 attached thereto. The tubular sheath may be openable and sealable along its side portion, or adjustable by a Velcro™ means 18 or the like for receipt of a reader's hand or preferably one or more fingers or thumb thereof. The tubular sheath 16 attached to the first panel 14 may have securement means 20 arranged therebetween, such as a rivet or the like to permit rotation of the panel 14 with respect to the sheath 16, as represented in FIG. 5. The first panel 14 has a lowermost end 22, with a second panel 24 thereattached. The second panel 24 may be rigidly formed (co-extruded) at the lowermost end 22 of the first panel 14, or the second panel 24 may be hingedly attached to the first panel 14 by a hinge 26 which in its open configuration forms a generally L-shape, as may be seen in FIGS. 1 and 2. The second panel 24, in a preferred embodiment, may have a third panel 28 there-attached. The third panel 28 may be attached to the distalmost end 30 of the second panel by a hinge 32 or the like. The third panel 28 in a preferred embodiment, may be shorter in length than the length of the second panel 24, as may be seen in FIGS. 2, 3 and 4, to permit rotation and articulation between the first, second, and third panels 14, 24 and 28, for storage purposes. The third panel 28, in its openmost configuration, is generally parallel to the plane of the first panel 14, as may be seen in FIGS. 1 and 2. The second panel 24 may have telescopable portions 25, as seen in FIG. 5, or otherwise compactable to permit a thinner book to be gripped by the holding device 10.

In its fully open configuration, a book "B" may be inserted between the first panel 14 and the third panel 28, so as to hold the pages properly compressed, as is shown in FIGS. 1 and 2. It is preferred, that at least the third panel 28 is constructed from a clear plastic material so as to permit the user or the reader to see therethrough.

In operation of the first preferred embodiment, the fourth or third finger of either hand may be placed within the generally cylindrically shaped flexible sheath 16, as shown in FIGS. 1 and 2, with the first panel 14 being supported against the inwardly facing (palm) side of the hand. The second and the third panels 24 and 28 are thus opened so as form a generally trough-like or U-shaped configuration for the receipt of the lower edge of a book "B" therein. The thumb of that same hand may be utilized by the reader to hold the other half portion of the pages of the book "B" open, as the reader wishes to hold and support that book "B" with that "one" hand to which the book holding device 10 is attached.

A further configuration of the first preferred embodiment of the present invention involves the use of the book holding device 10 with the generally cylindrically shaped sheath 16 rotated 90 degrees to the longitudinal axis of the first panel 14. This permits the second panel 24 to be in engagement with the side edges of the book "B" being held and not the lowermost edge of the book "B", when the user is supporting a book "B" in one hand, as represented in FIG. 5.

Figure 6:
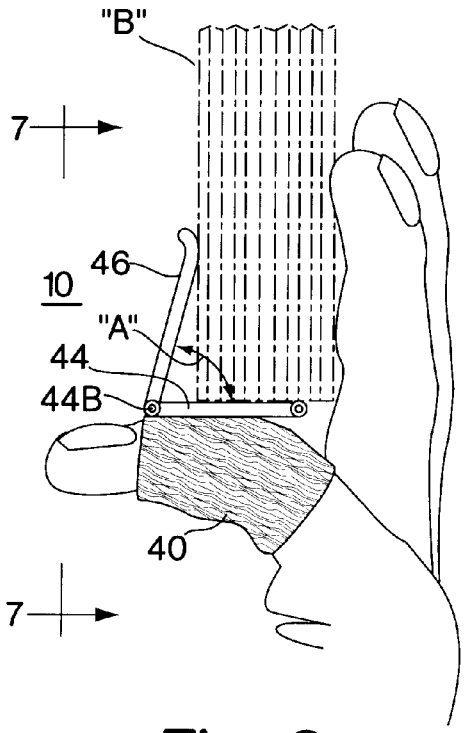
FIG. 6 is a side elevational view of a further embodiment of the present invention.
Figure 7:
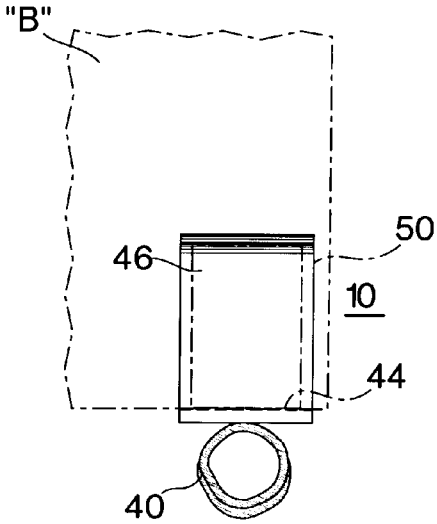
FIG. 7 is a view taken along the lines 7—7 of FIG. 6.

In yet a further preferred embodiment of the present invention 10, as shown in FIGS. 6 and 7, a generally cylindrically shaped flexible sheath 40 of about 2 centimeters in length, has a first panel 42 fixedly attached thereto. The sheath 40 and first panel 42 have a first end 44 to which a second panel 46 is attached. The second panel 46 may be attached by a hinge 48 to the end of the first panel 44. The second panel 46 is preferably transparent, inasmuch as it covers a portion of the page to be read by the reader holding the book "B". In a further embodiment of the present invention, the first and second panel may be a generally L-shaped extrusion (at about 60° to 120° angle, as seen in FIG. 6), the panels 44 and 46 not being hingedly arranged with respect to one another. In a yet further preferred embodiment, as shown in FIG. 7, the panels 44 and 46 may be comprised of wire 50, such as stainless steel, Nitinol, or the like, which would function in a bendable, yieldable manner by which to hold a book open and in place, while permitting the reader to easily see the pages.

In operation of the second preferred embodiment of the present invention, the generally cylinder shaped sheath 40 is placed on one of the fingers of one hand, so that the second panel 46 may be flipped-up in an upright orientation, as shown in FIG. 6, nearest the distal tip of the finger and generally perpendicular to the longitudinal axis of the distalmost end of the finger. A book "B" may be placed between the second panel 46 and the palm side surfaces of the remaining fingers of the users hand in which is holding the book "B". The second panel 46 may be arranged so as to hold one side of the book "B" against the reader's fingers, and the reader's thumb is holding the other side of the book "B" thereagainst as well.

Thus what has been shown is a unique readily manufactureable device for permitting a user or reader to hold a book with only one hand. The device includes a flexible, size adjustable, finger (or thumb) encircling sheath onto which a panel is attached. The panel is supported by the sheath that is placed about the finger to permit a book to be held between the panel and the remaining fingers of a single hand. This arrangement permits a reader to comfortably and easily maintain a book in its open orientation between the device, the fingers, and the thumb of one hand while permitting the user's other hand for writing, eating, or the like.

I claim:

1. A book holding device for permitting the comfortable holding of a book by a single hand of a reader of said book, said device comprising:

a sheath arranged for receipt of a portion of a reader's hand; and a frame assembly attached to said sheath, said frame assembly comprising a first panel attached to a second panel and said second panel is attached to a third panel in an extended array, which frame assembly is arranged to supportively receive at least one side of a book.

2. The book holding device as recited in claim 1, wherein said frame assembly is movable with respect to said sheath.

3. The book holding device as recited in claim 1, wherein said sheath is arranged to receive a finger of said reader's hand.

4. The book holding device as recited in claim 1, wherein said panels of said frame assembly are articulable with respect to one another.

5. The book holding device as recited in claim 1, wherein said second panel is hingedly attached to said first panel by a hinge arranged therebetween.

6. The book holding device as recited in claim 1, wherein said third panel is hingedly attached to said second panel by a hinge arranged therebetween.

7. The book holding device as recited in claim 1, wherein said third panel is fabricated by a transparent material to permit a book page to be read therethrough.

8. The book holding device as recited in claim 1, wherein said frame assembly is rotatable with respect to said sheath.

9. The book holding device as recited in claim 8, wherein said frame assembly is attached to said sheath by a rivet arrangement.

10. The book holding device as recited in claim 1, wherein said sheath is fabricated from a flexible material.

11. The book holding device as recited in claim 1, wherein said sheath is adjustable in size.

* * * * *